US005203272A

United States Patent [19]

Kassinger et al.

[11] Patent Number: 5,203,272

[45] Date of Patent: Apr. 20, 1993

[54] FLEXIBLE DOUBLE HULL FOR LIQUID CARGO VESSELS

[76] Inventors: Rudolph Kassinger, 94 Barchester Way, Westfield, N.J. 07090; Panos Zachariadis, 235 W. 48th St., New York, N.Y. 10036

[21] Appl. No.: 744,451

[22] Filed: Aug. 12, 1991

[51] Int. Cl.[5] ..... B63B 25/12

[52] U.S. Cl. ..... 114/74 R; 220/403; 220/404

[58] Field of Search ..... 114/256, 74 R, 74 A, 114/74 T, 68, 69; 220/403, 404, 560, 562

[56] References Cited

U.S. PATENT DOCUMENTS

| | | | |
|---|---|---|---|
| 2,991,906 | 7/1961 | Eligoulachvili | 114/74 R |
| 3,272,373 | 9/1966 | Alleaume et al. | 114/74 R |
| 3,663,976 | 5/1972 | Momany | 114/69 X |
| 3,671,315 | 6/1972 | Iarossi | 114/74 A |
| 3,844,239 | 10/1974 | McLaughlin | 114/74 R |
| 3,859,944 | 1/1975 | Warner | 114/74 R |
| 4,230,061 | 10/1980 | Roberts et al. | 114/74 A |
| 4,301,006 | 11/1981 | Davis et al. | 114/74 R |
| 4,484,533 | 11/1984 | David | 114/74 R |

*Primary Examiner*—Sherman Basinger
*Attorney, Agent, or Firm*—Evenson, McKeown, Edwards & Lenahan

[57] ABSTRACT

A system of puncture-resistant and tear-resistant flexible skin, placed inside the steel cargo tanks of existing or newly-built crude/product carriers (oil tankers), enclosing their liquid cargo with a leak-proof seal while creating a void space between the outer surface of the flexible skin and the inner surface of the steel tanks. The purpose of the invention is to prevent leakage of cargo to the sea in case of groundings or collisions, wherein the steel bottom or side hull of the ship is breached but the flexible inner skin remains intact due to the distance separating it from the steel outer hull and its property to deform, yield or "give". Arrangements and means of attachment are further described.

32 Claims, 7 Drawing Sheets

FLEXIBLE DOUBLE HULL FOR LIQUID CARGO VESSELS

BACKGROUND OF THE INVENTION

It is conventionally believed that vessels (ships) with double steel hulls or double bottoms have a better chance of avoiding cargo spills during accidental groundings or collisions, as compared with vessels constructed with a single steel hull. The conventional wisdom is that, although the outer hull may be penetrated during an accident, the inner hull is likely to remain intact and, therefore, the liquid cargo, being enclosed by the inner hull, will not leak to the sea. The marine industry, however, remains fairly evenly divided on the subject. Some arguments challenging the effectiveness of double hulls and/or double bottoms, other than their cost, include the following.

Double hulls can be effective only during "low energy" groundings or collisions. A void space of only ten to twelve feet between the inner and outer hulls will be ineffective to prevent penetration of the inner hull during more severe grounding accidents or collisions. During a grounding, flooding of the void space in the double bottom or double hull with sea water will cause the ship to sink deeper onto the rocks or may even cause the ship to break in two, spilling most or all of the cargo. Salvage attempts on a ship with flooded double bottoms will be seriously hampered because of this sinking effect. Double-hull ships present additional safety problems due to the increased possibility of accumulation of explosive vapors within the enclosed void areas between the inner and outer hulls. Maintenance and inspection of the narrow spaces between the two hulls will be difficult and since these spaces normally will be used to carry water ballast, there are increased risks of undetected corrosion damage. Due to added steel weight, double hulls result in a loss of cargo carrying capacity as compared with a conventional single hull ship of equal volume. Apart from loss of income to the shipowner, this loss of capacity also results in more ships in ports and sea lanes to carry the same amount of oil and, consequently, increased chances for accidents and groundings.

Notwithstanding the above arguments, the "U.S. Oil Pollution Act of 1990" recently was signed into law, mandating that all new tankers operating within the 200-mile U.S. Exclusive Economic Zone (EEZ), be of double hull construction. The Act includes a phase-out schedule for all existing single hull tankers between the years 1995 and 2010. Some countries outside the U.S. appear ready to follow with similar laws. It is estimated that only 3% of the world's tanker fleet currently complies with the requirements of the "U.S. Oil Pollution Act of 1990". Since retrofitting existing tankers with double steel hulls is considered technically and economically impractical, it follows that only newly-built double-hull tankers may serve countries with such laws in the future. If one accepts the argument that "double hulls" spell " double trouble", one is faced with the requirement virtually to rebuild the world's tanker fleet with ships that may prove prone to more and larger oil spills.

It will be noted that in view of the new legislation prompted by recent accidents and the debate over double hull effectiveness, many innovative techniques have been suggested by the marine industry to prevent or limit oil spills when a hull breaching accident occurs.

Most of these suggestions deal with hydrostatic equilibrium of cargo and sea, or applying vacuum to cargo tanks or similar combinations. It is generally admitted, at least during the first few minutes of breaching, that some oil may escape to the sea with any of these designs.

The present invention provides an improved arrangement for preventing oil spills. Additionally, apparatus constructed according to this invention may be easily and cheaply installed (retrofitted) in existing single hull tankers, making them effectively double-hulled. A flexible inner hull resists breaching far better than a rigid steel hull. At the same time, all the aforementioned disadvantages of steel double hulls are substantially avoided.

DESCRIPTION OF PRIOR ART

U.S. Pat. No. 4,347,798 of J. J. Gallagher issued Sep. 7, 1982 describes a system of flexible buffer tanks placed at the bottom and sides of a ship's cargo tanks. The buffer tanks feature a bottom shaped to fit over the ship's bottom scantlings. The buffer tanks are attached to the steel platings by adhesives. The buffer tanks are not intended to prevent cargo spills by enclosing the cargo, but rather by acting as a buffer below the cargo. Whereas the buffer system becomes part of the ship's scantlings, the present invention stays well out of the way of the ship's scantling and piping allowing for ease of installation and, by being away from the ship's external platings, providing superior cargo protection from penetrations. Such a buffer system is considered impractical in that, among other deficiencies, it requires custom shaped bottoms for the buffer tanks to fit each individual ship, it does not allow access for inspection of the steel surfaces to which the buffer tank is adhered (as international regulations require), and it does not account for operational requirements such as piping arrangements for cargo discharge.

U.S. Pat. No. 3,785,321 of A. L. Backstrom issued Jan. 15, 1974 describes a flexible shield extending along the sides of the ship's hull with the cargo resting on a bed of water. That configuration is significantly different from the present invention in that the cargo is not enclosed and the flexible side shields are not intended to protect anything. The shields are merely used to provide columns of water for hydrostatic pressure on the ship's bottom which would offer essentially no protection to turbulent discharge of cargo.

U.S. Pat. Nos. 4,478,165 and 4,117,796 of J. P. Strain describe systems of movable double bottoms whereby flexible diaphragms connect the movable parts to the stationary parts to allow for movement and the carriage of oil and ballast water in compartments within the same physical space.

U.S. Pat. No. 4,409,919 of J. P. Strain describes a flexible bag within a ship's cargo tank restricted inside a rigid cage whereby the bag can expand when filled with ballast water or other cargo in order to alternatively utilize the same physical space for various liquids.

U.S. Pat. No. 3,707,937 of H. Liles describes a collapsible container made of elastic material whereby the container can expand when filled with ballast water or other cargo.

U.S. Pat. No. 3,943,873 of F. S. Hering et al describes a ballasting system whereby flexible membranes separate the cargo tanks into cargo and ballast sections for alternate carriage of these liquids in the same physical space. The purpose of each of the above configurations is to utilize the same physical space within a ship's cargo tank with the flexible partitions being used to separate different liquids. The various flexible partitions in these configurations are not intended nor are they configured to protect the cargo in the event of a break in the hull.

SUMMARY OF INVENTION

The invention comprises a system of puncture and tear-resistant, flexible skin(s) or bags to convert a single hull ship to an effective double hull configuration. The system consists of double-layered flexible bags whereby the outer layer of the bags is made of lightweight, high strength, woven fiber and the inner layer is made of petroleum-resistant flexible material such as nitrile rubber.

The bags are placed inside conventional cargo-carrying tanks enclosing and protecting the cargo from external penetration in the case of groundings or collisions. For outer (also referred to as "side" or "external") cargo tanks, full bags attached to the tanks' upper deck plating may be used, providing a flexible "double hull" for every tank fitted with the invention or, alternatively, for inner (also referred to as "internal" or "center") or outer tanks, partial bags may be used, attached to a steel ledge running along the tanks' vertical bulkheads, thus providing a flexible "double bottom" for these tanks. Since a ship's side tanks must be arranged to protect the cargo from both bottom and side hull penetrations, it is preferred that side tanks be fitted with full bags for double hull protection whereas center tanks may be fitted with modified partial (e.g., half) bags. The system of bags may be placed at any desired distance inwards of the ship's outer steel side shells and steel bottom to comply with regulations specified as a result of the "U.S. Oil Pollution Act of 1990".

Each bag is securely attached at its top periphery to the tank's steel deck or sides by either common or innovative clamping apparatus. The innovative attachment methods, as described in detail below, form part of this disclosure. Several arrangements for support of full or partial bags are described. These include: a) flexible pillow tanks filled with incompressible liquid wherein the pillow tanks are placed below the cargo-enclosing bags so that the bottoms of the cargo carrying bags rest on top of the pillow tanks; b) partially or completely filling the void spaces between the bags and steel sides and bottom of the cargo tanks with incompressible liquid or compressible gas; c) enclosing the bags in steel nylon, or fabric netting whereby the netting is attached at specified points on the tank walls; d) combinations and extensions of the above arrangements as described in detail below.

The inventors are aware of numerous innovations in the marine field that have never been applied in practice due to their inherent requirements for costly or impractical modifications and/or disregard for national and international regulations governing marine construction and operation. Although the primary objective of this invention is to prevent spillage of cargo in cases of hull breaching, a secondary objective is that the invention should be operationally compatible with current oil-tanker operational practices and existing regulatory requirements. To that end, the inventors have endeavored to ensure that installation and operation of the invention easily conforms with current marine practices and regulations. Under the section entitled "Operational Procedures", this particular aspect of the invention is presented in detail.

DETAILED DESCRIPTION

Figure 1:
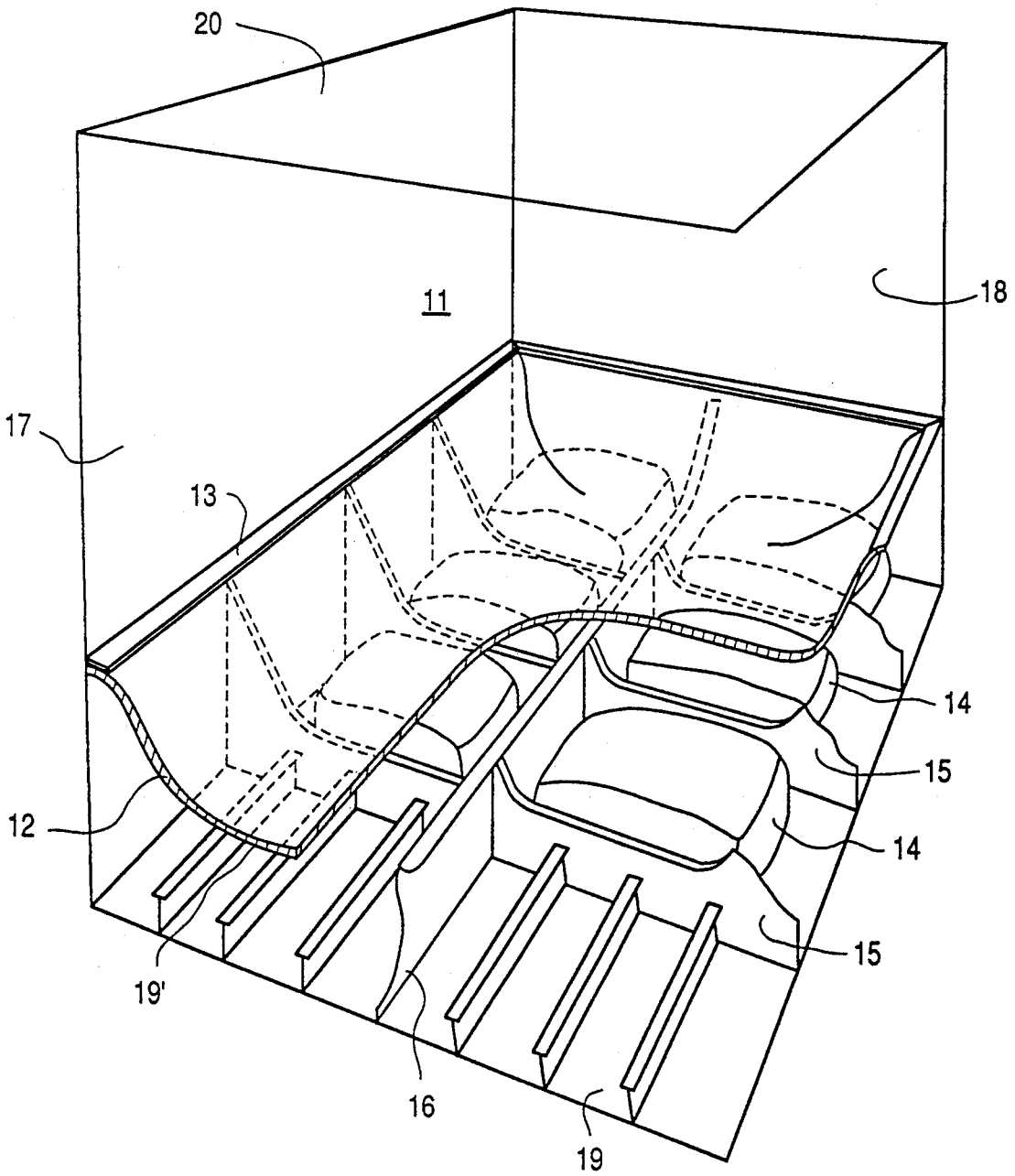
FIG. 1 shows a modified partial bag installed in a typical oil tanker center tank providing an effective double bottom which is flexible, tear resistant and leak proof.

Referring to FIG. 1, a center tank 11 fitted with one embodiment of the invention is shown. A reinforced double flexible bag 12 is attached to the tank bulkheads (side walls 17 and end walls 18) by clamping means (shown in detail in FIG. 7) at a steel support ledge 13 which runs horizontally along the inside of tank bulkheads 17, 18. The bag 12 may be made for example, of a composite or laminated material consisting of an outer layer of lightweight fabric woven from a high strength fiber product such as a para-aramid fiber (e.g., Kevlar), or a highly oriented, high molecular weight polyethylene fiber (e.g., SPECTRA) or polyamide fibers (e.g., nylon) or a polyester fiber (e.g., dacron) or steel wire and an inner skin composed of a petroleum-, chemical- and liquid- resistant film such as nitrile rubber or other similarly oil and/or chemical-resistant commercially available film material such as nylon, Teflon, Kynar, Viton, Delrin or Ryton. The outer skin provides structural support and puncture/tear-resistant properties whereas the inner skin is selected for being impervious to and inert with respect to the particular liquid cargo to be carried. The seal ledge 13 has the dual purpose of sealing the flexible bag 12 to the tank 11 and serving as a walking platform for inspection of the inner (top) layer of the bag 12. Manholes (not shown) provided on the steel ledge 13 will allow access to the underside area for inspection of the outer (bottom) layer of the bag 12 and the conventional steel walls 17, 18, 19 of tank 11 and associated steel members and piping in accordance with standard practices and regulations.

Figure 4:
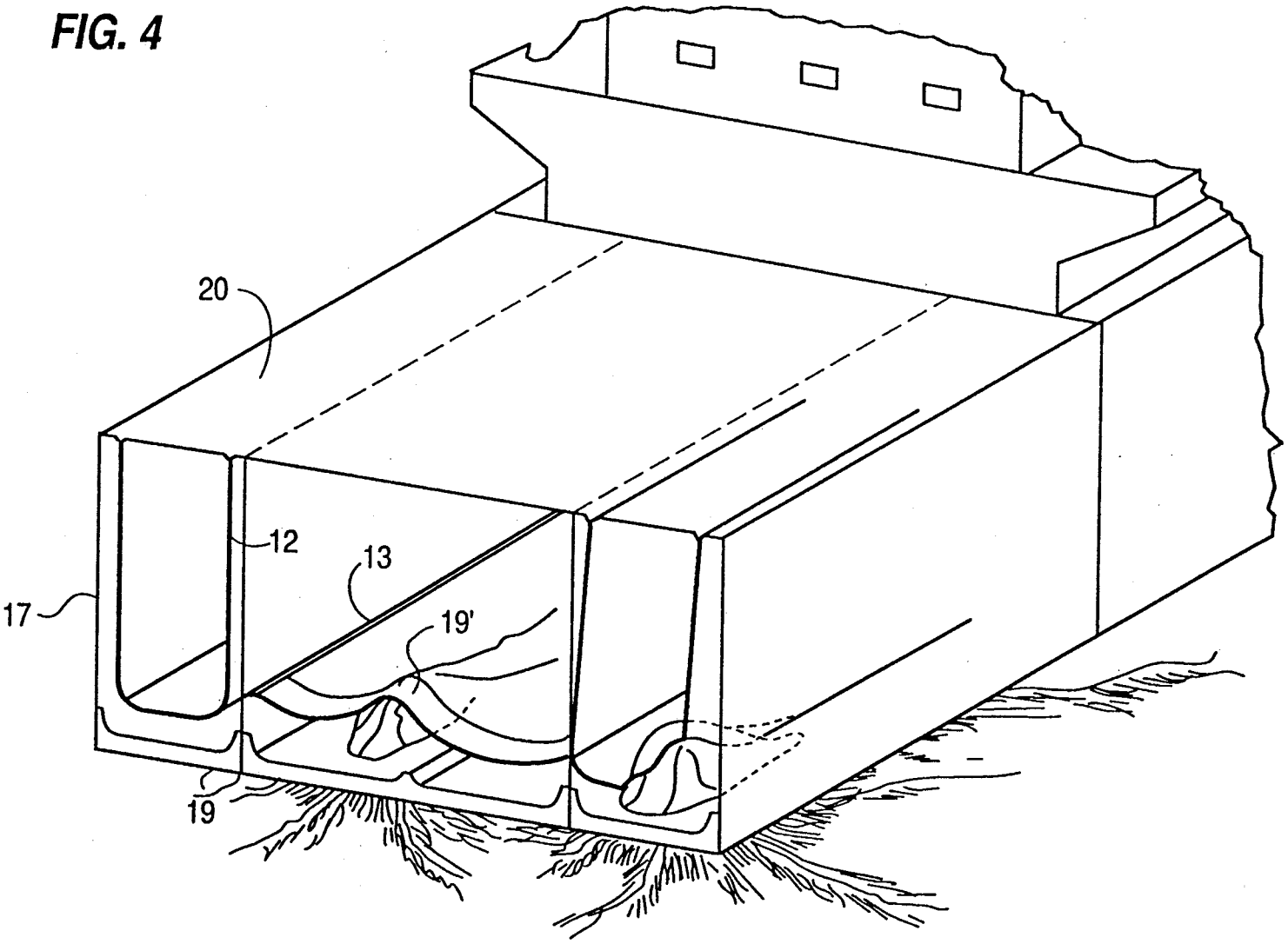
FIG. 4 is a three-dimensional view of a seriously breached oil tanker, illustrating how one embodiment of the invention is intended to function in such cases.
Figure 5:
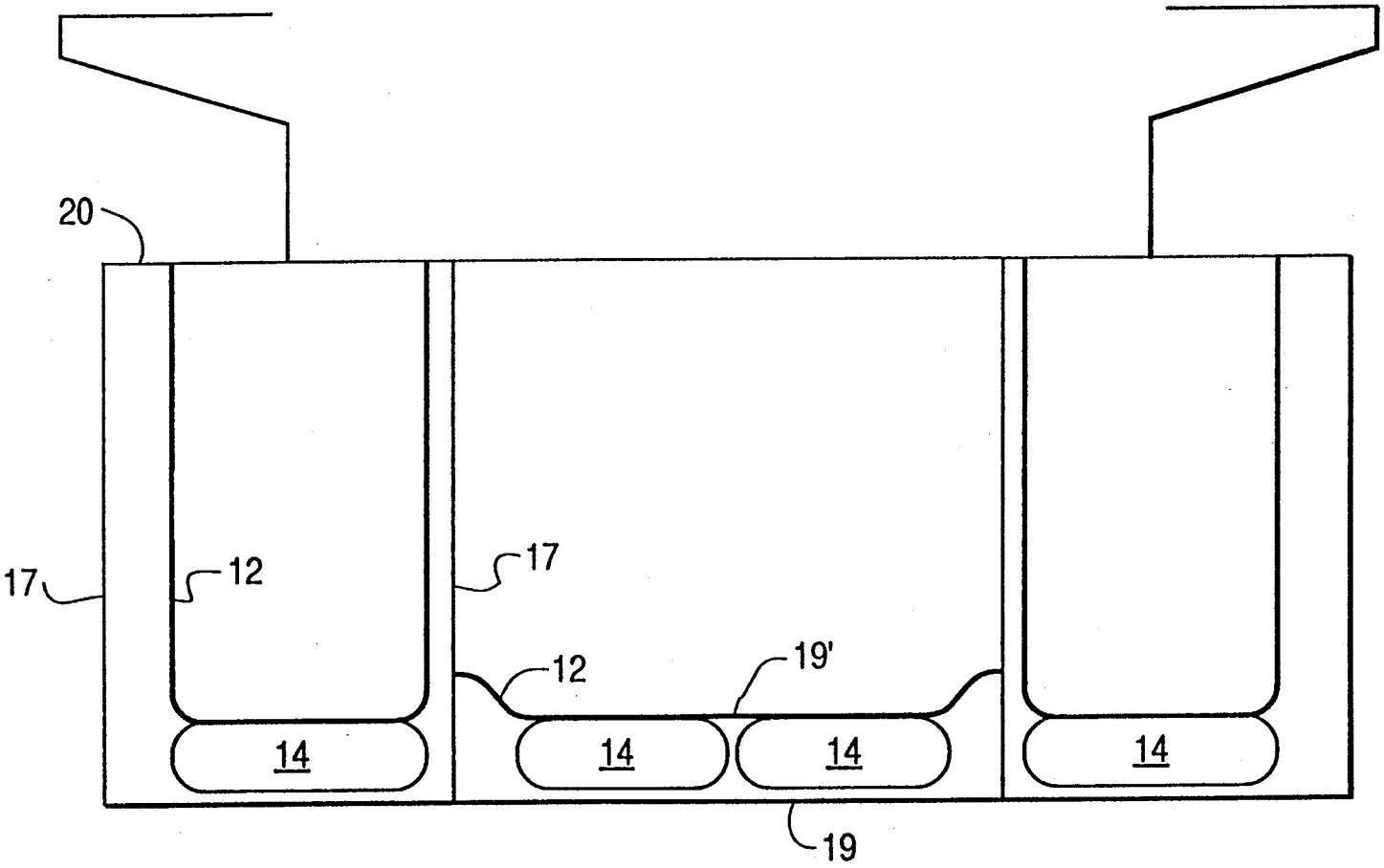
FIG. 5 is a transverse cross-section of an oil tanker fitted with another embodiment of the invention.

The conformation and attachment means of bag 12 allows it to sag toward the bottom 19 of the tank 11. The amount of sagging (i.e., the vertical distance from the steel ledge 13 to the bottom 19 of the bag 12 at its resting position) determines the effective double bottom clearance in cases of grounding where the tank bottom 19 is breached. In such a case, (as FIG. 4 illustrates) the flexible bag 12 has the ability to maintain its integrity despite significant penetration of tank bottom 19. The maximum deformation potential is distance twice the vertical distance from the steel ledge 13 to the bag bottom. This feature is beneficial in two important respects.

First, by placing the steel ledge 13 at a minimum height from the ship's bottom 19 as specified by double hull regulatory requirements, a much larger "effective" double bottom protection is achieved equal to the regulatory minimum plus the maximum deformation in potential ("give") of the bag 12, where the give is the distance from the steel ledge 13 to the bag bottom. This extra protection is effected throughout the tank bottom 19 except at the places of attachment of the bag 12 to the tank bulkheads 17, 18 at the ledge 13 position. However, the areas of the tank bottom plating at or near such bulkheads 17, 18 are the least prone to penetration cue to the reinforcement they receive from the bulkheads 17, 18. Thus the natural behavior of bag 12 to deform or "give", provides extra protection to the areas where it is most needed i.e., the center region of tank 11. Secondly, since the bag 12 sags below the regulatory clearance for steel double bottoms in normal cargo carrying operation, substantial extra volume can be utilized for the carriage of profit-earning cargo that would otherwise not be carried if the tank 11 was fitted with a rigid steel double bottom. Varying degrees of protection may be achieved by varying the position of ledge 13.

Continuing with FIG. 1, one arrangement for providing extra support, if required, for the bottom of bag 12 and the cargo carried over it is shown. Pillow tanks 14 made of material similar to the flexible bag 12 but not necessarily having puncture-resistant properties, and fitted with incompressible liquid, are shown placed between conventional transverse frames 15 of tank 11, on each side of centerline longitudinal structural member 16. Such tanks are known generally in this field and are available from commercial sources. The height of the pillow tanks 14 preferably is at least equal to that of the highest obstruction (e.g. frame member) on the bottom 19 of tank 11, which in this figure is the centerline longitudinal 16. The pillow tanks 14 may be of various sizes as required to fit within the particular spaces within tank 11, as formed by various longitudinals 16 and transverse frames 15. A secondary purpose of the pillow tanks 14 is to maintain the bottom of the bag 12 relatively flat to facilitate cargo discharging. To that end, it may be desirable that the top surface of the pillow tanks 14 be made of a stiffer material such as a plastic plate (either as an integral part of the pillow tank 14 or separate from it), whereas the sides and bottom of the pillow tanks 14 preferably are flexible material to easily fit around or over tank bottom obstructions such as low longitudinals, piping etc. If desired, pillow tanks 14 of varying heights can be used to provide a smooth inclination to the bottom of bag 12 so that the cargo flows easily towards a discharge opening (not shown). Yet a third purpose of the pillow tanks 14 would be to serve as the first line of defense against sea pollution (if the hull is breached) by being filled with commercially available chemical dispersant which also serves as the incompressible liquid inside the pillow tanks 14. A major problem with oil dispersants which limits their effectiveness in cases of oil spills is a requirement for speedy deployment. In cases of catastrophic hull breaching the pillow tanks 14 will rupture, releasing their chemical dispersant early, when it is most effective.

Figure 2:
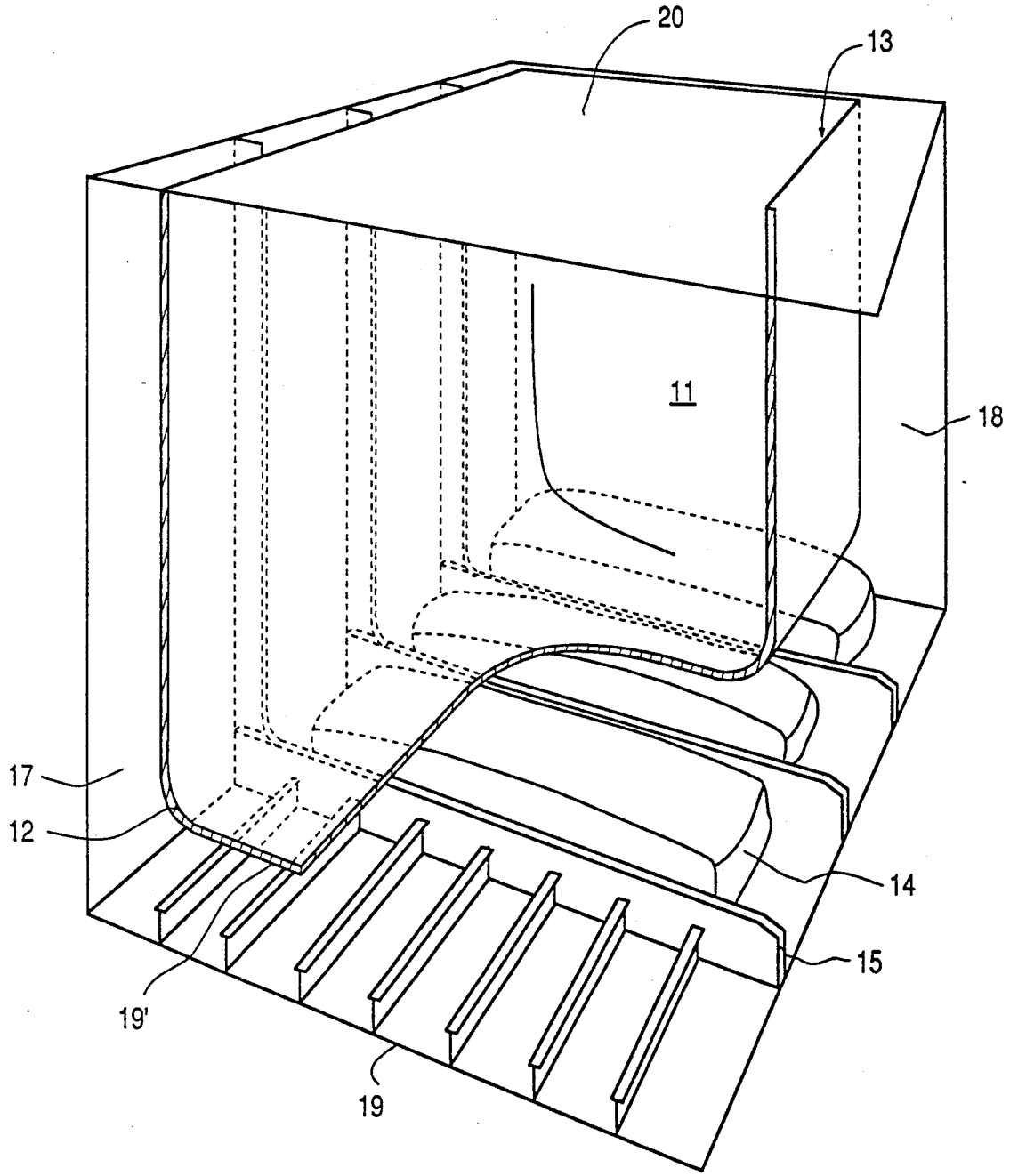
FIG. 2 shows a full bag installed in a typical oil tanker side tank, providing an effective double hull which is flexible, tear resistant and leak proof.
Figure 3:
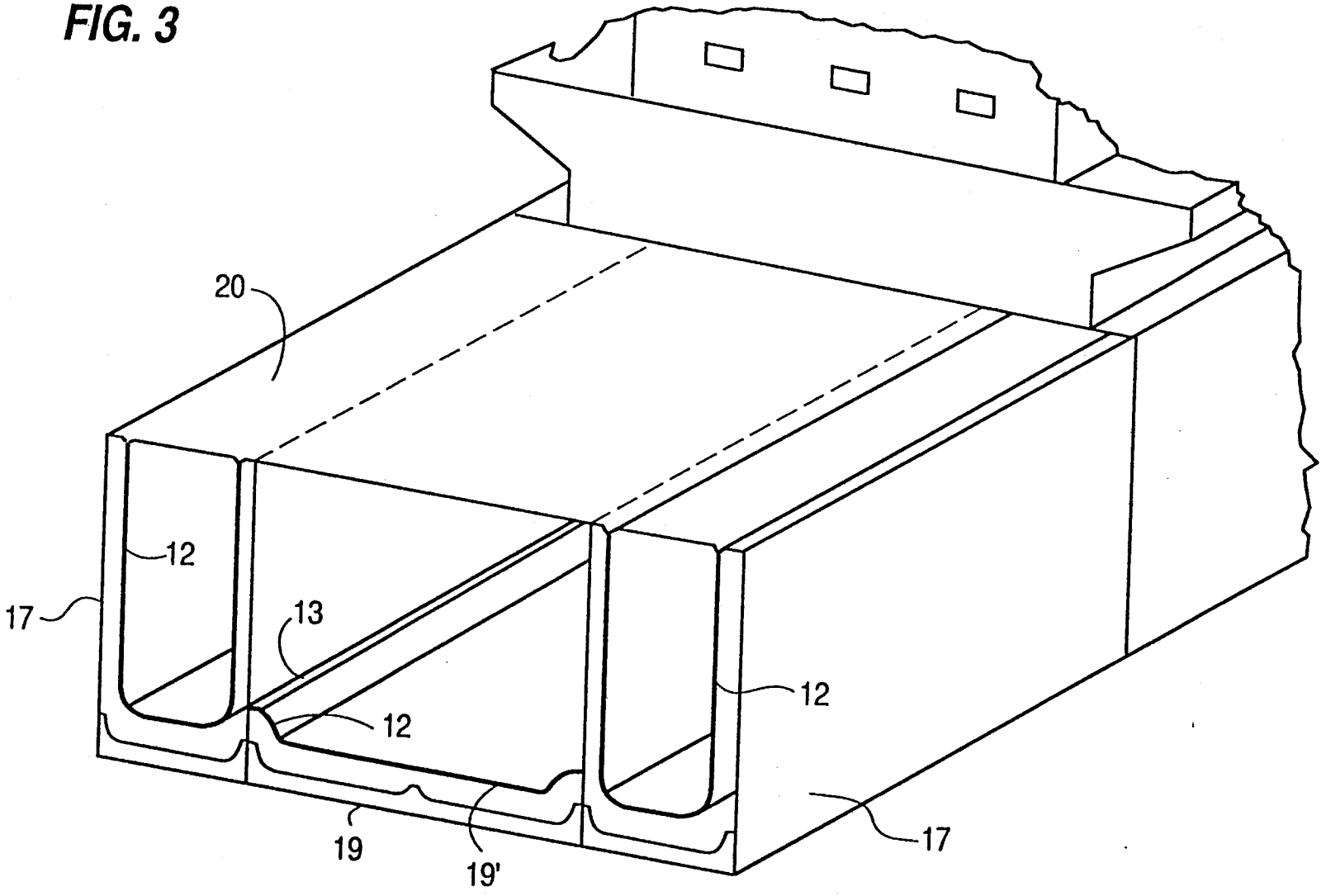
FIG. 3 is a three-dimensional sectional view of an oil tanker fitted with one arrangement according to the invention.

FIG. 2 shows an arrangement preferred for side tanks in a ship in line with the double hull requirement. In this embodiment, a full bag 12 is suspended from the upper deck plating 20 by means of a clamping arrangement 13 shown in detail in FIG. 7. Manholes (not shown) on the upper deck 20 can allow access to all steel parts of the tank 11 for maintenance and inspections, as with any conventional oil tanker. As FIG. 4 illustrates, the bag 12 can "give" in more than one direction, providing superior protection to the cargo. Since the bag 12 can give sideways as well as vertically and depending on the actual regulations concerning steel double hull clearances yet to be specified at the time of this writing, the attachment of bag 12 to the upper deck 20 may be placed closer to the tank side shell plating vis-a-vis steel double hulls to take advantage of the deformation potential of the flexible skins. This is feasible since a) the attachment of the bag 12 to the upper deck plating 20 always remains above sea level and b) the property of the bag 12 to give sideways will provide double hull protection well above the regulatory minimum requirement. A further advantage is increased cargo volume available for freight-producing cargo.

In most existing oil tankers, swash bulkheads (heavy transverse frames) divide side tanks into two or more sections. For such ships, two or more full bags 12 can be used for each side tank. The additional expense for multiple bags will be mostly that of the additional required piping for filling/discharge. Wider pillow tanks 14 of approximately the same width as the flexible bag 12 can be used for support since side tanks usually do not feature large longitudinals such as the centerline longitudinal 16 of FIG. 1.

Figure 6:
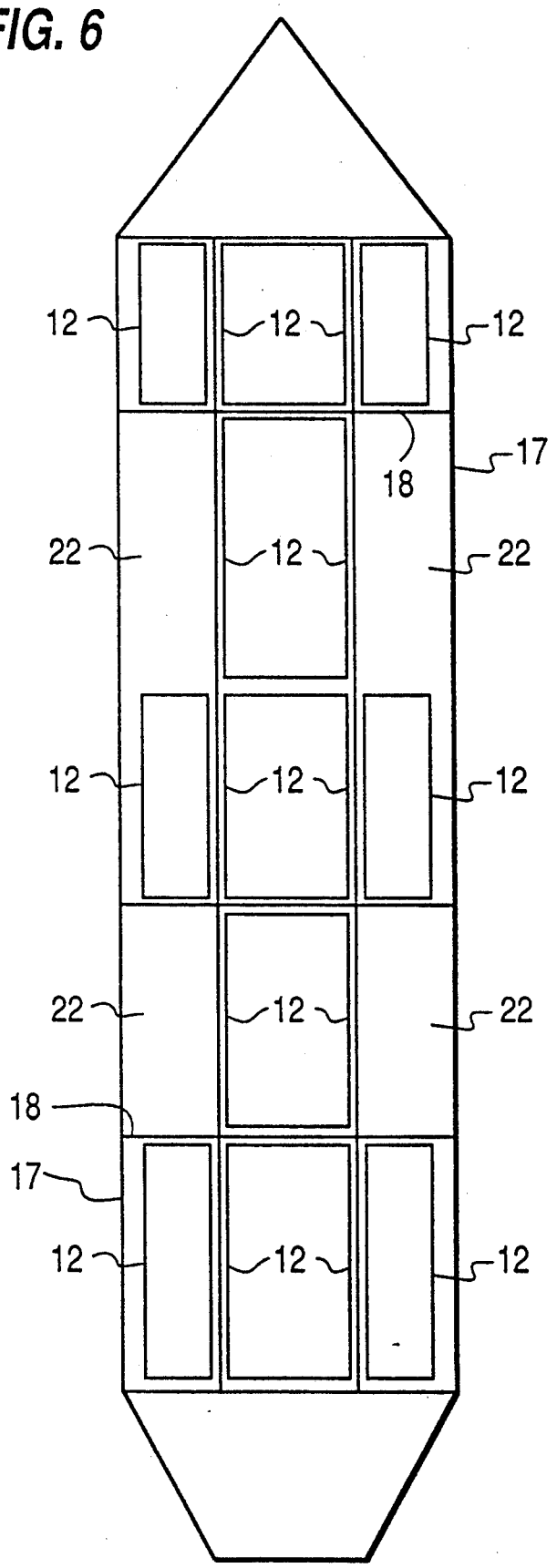
FIG. 6 is a plan view of an oil-tanker fitted with a system in accordance with the invention.

Referring to FIG. 6, a typical top-view arrangement according to the invention is shown. The tanks 22 represent conventional ballast tanks for which there is no need for flexible bags 12 to be fitted since these tanks 22 do not carry cargo. It is recognized that large forces will be exerted at the sealing attachments of the flexible bags 12 to the steel tank platings (13 or 20) if the flexible bags 12 are not provided with bottom support. In the static case, these forces are the result of gravity due to the weight of the cargo enclosed in the bags 12. Proper reinforcement of the sealing areas as well as a provision so that the bottom of flexible bag 12 stays flat, or at a suitable slope to facilitate discharging, would ensure that the arrangement does not require added bottom support to function as intended. Several arrangements can be used to provide such a free-hanging bag 12 with the desired form, such as enclosing strips of stiffer material, or rigid plastic support, between the inner liquid-resistant and the outer puncture-resistant layers of the bag 12. For the flexible bags 12 attached to side tanks, restriction of the sides of bags 12, such as wires or turnbuckles connecting the vertical sides of the bag to the adjacent steel plating, may be provided to minimize the tendency of the bags 12 to experience pendulum motion when the ship is rolling in heavy seas and, thus, reduce any stresses at the sealing attachments due to the tendency to roll. However, should support for the bottom of flexible bag 12 be desirable to avoid reinforcement and additional materials in the bag layers, several methods of additional support are disclosed here below.

Pillow tanks 14 have already been described. Secondly, filling of the void space between the bottom of bag 12 and the tank bottom plate 19 with incompressible liquid such as water or a chemically treated mixture of water and oil dispersant may be employed. In side tanks, the level of a supporting liquid can be much higher than the bottom of bag 12 so that the liquid not only supports the bag 12 but also provides damping action to the sides of bag 12 to minimize motion thereof when the ship is rolling. Pressurized gas, such as air or inert gas, may be used to fill the void volume between the bag 12 and the ship's hull 19.

The whole flexible bag 12 may be enclosed in netting made of high strength material such as steel wire or high strength fiber products of the type described above in the first paragraph of this "Detailed Description". The netting is then connected at several places to the steel hull supporting the flexible bag 12 and its cargo. For the full flexible bags, side connections between netting and the tank's steel hull may be used for motion damping of the flexible bag 12.

Suitable combinations of the above methods can be utilized. For example pillow tanks 14 and incompressible liquid filling all void spaces between the pillow tanks 14 to provide a smooth surface where the bag 12 bottom can rest, is a very advantageous method from several respects. With this combination, the pillow tanks 14 are not required to be constructed of high strength material and they can be used for storage of chemical dispersant ready to be released in the event the steel hull 19 is penetrated.

Figure 7A:
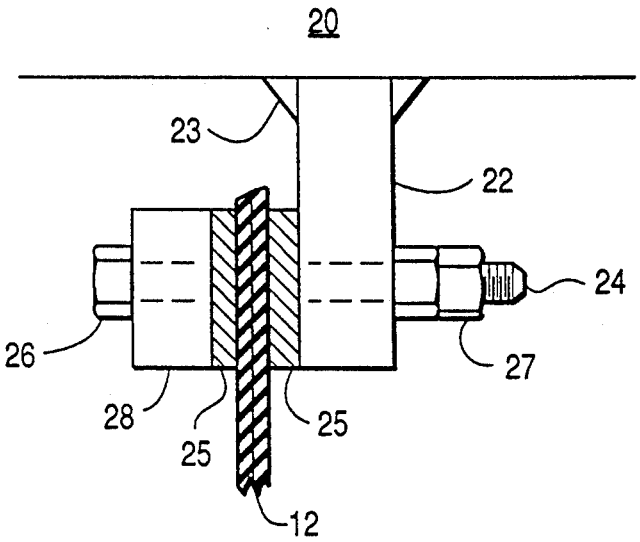
FIG. 7(*a*)(*b*) and (*c*) show bag clamping arrangements for side or center tanks.

FIG. 7*a* shows a sealing clamping arrangement using a first clamping means to attach the flexible bag 12 to the steel plating 20 or ledge 13. The arrangement for a full bag 12 in a side tank is depicted whereby the bag is hanging from the upper deck plating 20. In this arrangement, a first flat steel bar 22 of sufficient dimension is welded by a continuous weld bead 23 to the deck plating 20. By tightening a stud bolt 24, using nuts 26 and 27, a second flat steel bar 28 is pressed towards rubber gaskets 25 and the flexible bag 12, effecting sealing, and separating the area to the left of the flexible bag 12 from the area to the right. Rubber gaskets 25 are optional and stud bolt 24 may, or may not, penetrate the skin of the flexible bag 12.

Figure 7B:
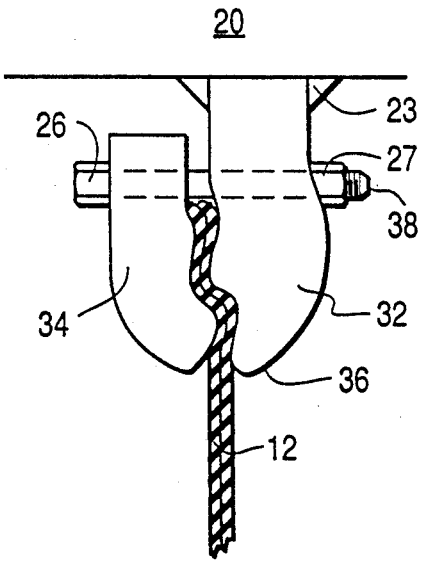
Figure 7C:
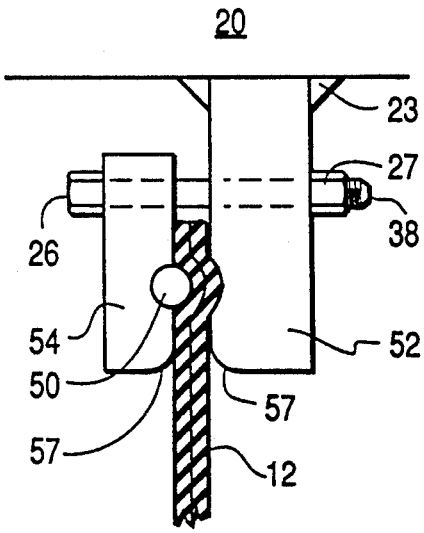

FIGS. 7*b* and 7*c* illustrate a preferred sealing arrangement. In FIG. 7*b*, clamp members 32, 34 are shown which feature male-female pressing surfaces for superior oil-tight sealing. Gaskets made of rubber or other material are optionally used (not depicted in FIG. 7*b*) and the stud bolt 38 preferably does not penetrate the skin of flexible bag 12. Chamfered (rounded) corners 36 are employed at the lower inner corners of the clamps 32, 34 to avoid damage to the skin of flexible bag 12 when the bag 12 is moving due to rolling. The arrangement shown in FIG. 7*c* is simpler to manufacture whereby a whole or half round bar 50 is welded to a flat bar 54 and a concave circular groove is provided at the corresponding side on flat bar 52. For good sealing, the circular groove should be of larger curvature radius than the radius of round bar 50. Chamfered corners 57 are provided at the lower inner corners of the clamps. Optional gaskets or padding may be used on the steel-to-flexible-bag-skin contact areas and stud bolt 58 may, or may not, penetrate the bag.

OPERATIONAL PROCEDURES

The illustrated arrangements are considered to be in full compliance with current U.S. and international regulations for tanker construction and operation. Furthermore, use of the invention does not require any changes in established operating procedures such as loading and discharging of cargo or performance of maintenance work. Use of the invention does not require revision of inspection and enforcement procedures and practices by classification and regulatory bodies. Although such practices are too numerous to mention herein, it should be noted that all parts of the vessel must remain accessible for inspection, maintenance and repairs in the same way as if the invention was not installed. The present invention meets that requirement. Further operational procedures are presented below for the case where the invention is installed on a conventional oil tanker as a retrofit with the understanding that, in a newly-built tanker incorporating the invention, preplanning of piping arrangements and steel appendages will greatly simplify installation and operation of the invention.

In a conventional oil tanker, cargo and ballast loading and discharge piping runs mostly along the bottom of the tanks. The invention may be incorporated by simply modifying only the bellmouth portion of that piping (not shown) whereby 90 degree elbow sections just above the bellmouth (suction or discharge end of piping) may be rotated by 180 degrees to face upwards, penetrating the bag 12 only at this suction/discharge point. Thus the piping will remain at the double bottom area below the bottom of the flexible bag 12. The bellmouth will be replaced by suitable oil-tight penetration pieces which preferably incorporate safety features such as spring loaded flaps or hydraulic or mechanical one-way valves that would automatically seal the opening in flexible bag 12 in cases of hull breaching, whereby the flexible bag 12 is pushed upward, thus causing the discharge pipe to separate from the load and discharge opening. Most other piping in existing oil tankers enters the tanks from upper deck penetrations. Since the invention features an open top, such piping like crude oil washing and steam heating pipes may enter the cargo space from the top with no penetrations of the bag's flexible skin. Additional advantages of the invention involve much reduced cargo heating requirements due to the bag's insulating effects and easier crude oil or water washing procedures due to the smoothness and oleophobic characteristics of the bag's inner layer.

Flowmeters at the load and discharge piping (not shown) of each tank will be a suitable means to calculate each tanks cargo content since ullage methods may be inaccurate due to the flexibility of the bag 12.

As with conventional oil tankers, a slight percentage of the available cargo space is to be left unused. Whereas this allows for cargo expansion due to heating in conventional tankers, the same procedure will allow cargo displacement in cases of hull breaching, whereby the bag's surface is caused to be displaced.

It is noted that for reasons of clarity the disclosures in connection with the invention have centered around the application of embodiments as installed in a conventional oil tanker. It is to be understood, however, that many modifications and variations of the present invention are possible in light of the above disclosures both in regard to the invention's configurations as well as to its application to vessels other than oil (crude and product) tankers such as chemical tankers, liquified gas carriers, other liquid carriers and liquid carrying barges. For example, depending on the shipowner preferences and applicable regulations, all cargo tanks may be fitted with either full or modified, partial or half-bags. Should future regulations disallow cargo piping in the double bottom space, such piping may enter the flexible bags through oil tight penetrations. In such case, bellmouths inside the bag may be used for cargo discharge whereby a non-flexible plate on the bag bottom, in the area of the suction bellmouth or a steel or plastic cage configuration surrounding the bellmouth may be used to prevent the flexible bag skin from closing in on the suction bell-mouth.

What is claimed is:

1. In a liquid cargo vessel having an outer, substantially watertight structural hull comprising a bottom portion and upstanding side wall portions and one or more horizontally disposed decks defining, in combination, a maximum closed liquid cargo space, said vessel further having a plurality of interior bulkheads, at least some of which are fastened at extreme ends to said hull, and a plurality of vertical walls which are spaced away from said hull side walls and intersect said bulkheads; said hull side walls, portions of said bottom portion and said bulkheads and selected ones of said vertical walls forming exterior compartments and said other portions of said bottom portion and said bulkheads and said vertical walls forming interior compartments within said cargo space, apparatus for preventing the discharge of liquid cargo from said cargo compartments when said vessel is subjected to puncture below the cargo line by a foreign object comprising:

a flexible, free-hanging composite liner impermeable to a desired liquid cargo material having an area extending across at least one of said compartments at least in the vicinity of the portion of the hull forming said at least one compartment; and means for fastening said liner within said compartment in a sagging manner retain said liquid cargo therein and to provide cargo-free space between said hull and said liner, the minimum distance between said hull and said liner when said liner contains cargo being selected and the location within said compartment of said means for fastening being selected such that said cargo is retained within said liner despite puncture and entry into said hull by a foreign object to a distance greater than said minimum distance.

2. Apparatus according to claim 1 wherein:

at least one of said compartments is an interior compartment; and said means for fastening said liner is disposed within said interior compartment above said portion of said bottom of said hull at a height below a midpoint of said interior bulkheads and at or above a predetermined amount.

3. Apparatus according to claim 2 wherein:

said means for fastening is below the water line for said ship when loaded with cargo.

4. Apparatus according to claim 3 wherein:

said liner comprises a flexible, integral, liquid impermeable bag having a bottom portion and vertically extending side wall portions, said side wall portions being dimensioned so that said liner contains a volume of liquid cargo which is substantially less than the volume of liquid cargo contained within an associated interior compartment.

5. Apparatus according to claim 3 wherein:

said means for fastening comprises a rigid ledge fastened to sides of said compartment; and a clamp fastened to said ledge and adapted to receive an upper boundary of said flexible liner so as to form a leak resistant seal along said boundary to retain liquid cargo within said compartment.

6. Apparatus according to claim 1 wherein:

at least one of said compartments is an exterior compartment; and said means for fastening said liner is disposed within said exterior compartment at a height substantially above a midpoint of said bulkhead.

7. Apparatus according to claim 6 wherein:

said means for fastening is disposed at a height which is above the water line for said ship when loaded with cargo.

8. Apparatus according to claim 6 or claim 7 wherein:

said liner comprises a flexible, integral, liquid impermeable bag having a bottom portion and vertically extending side wall portions having dimensions sufficient to contain a volume of liquid cargo which is less than but a major fraction of the volume of an associated exterior compartment.

9. Apparatus according to claim 1 wherein:

said flexible composite liner comprises an inner sheet of cargo-resistant material selected from the group consisting of plastic, rubber and polymeric material and surrounded by a woven fabric of high tensile strength fiber or steel wire which, upon filling of its respective compartment with liquid cargo, extends not more than to a predetermined minimum distance from said hull.

10. Apparatus according to claim 1 and further comprising:

a support netting, having an elasticity less than that of said flexible liner, mounted within said compartment outside of said liner for confining said liner to a predetermined maximum volume within said compartment.

11. Apparatus according to claim 10 wherein said support netting is selected from the group of materials consisting of steel, high strength para-aramid fiber, highly oriented polyethylene fiber, polyamide fiber and polyester fiber.

12. Apparatus according to any of claims 2 or 6 wherein:

said means for fastening said liner comprises a rigid ledge fastened to sides of said compartment: and a clamp fastened to said ledge and adapted to receive an upper boundary of said flexible liner;

said clamp comprising first and second complimentarily shaped clamping portions for receiving said boundary of said liner and adjustable fastening means for compressing said liner between said clamping portions so as to form a leak resistant seal along said boundary to retain liquid cargo within said compartment.

13. Apparatus according to claim 12 wherein said complimentarily shaped clamping portions are, respectively, a rounded bar and a corresponding groove of larger radius of curvature than said bar to provide a leak resistant seal with said liner.

14. Apparatus according to any of claims 1–7 and 4–5 wherein said liner is formed of oil resistant material selected from the group consisting of nitrile rubber, nylon, Teflon, Kynar, Viton, Delrin and Ryton.

15. The liquid cargo vessel according to claim 1, wherein said liner is provided with material sufficient to allow said liner to sag when loaded with cargo so as not to exert undue resistance to a foreign object penetrating said compartment when said object enters by a distance greater to said predetermined minimum distance between said liner and said compartment's bottom and walls.

16. The liquid cargo vessel according to claim 1 wherein said liner is configured and attached so as to allow said liner to be locally and wholly laterally displaced without undue resistance to said penetrating foreign object when said object enters said compartment by a distance greater to said predetermined minimum distance between said liner and said compartment bottom and walls.

17. A method for preventing the discharge of liquid cargo from a vessel when such vessel is subjected to puncture below the cargo line by a foreign object, wherein said vessel comprises an outer substantially water tight structural hull having at least a bottom and side walls enclosing, in cooperation with decking, a cargo space, the vessel further comprising;

a plurality of interior rigid bulkheads, at least some of which are fastened to said hull, to define compartments within the cargo space; the method comprising:

suspending in a sagging manner within each liquid cargo compartment so as to be free-hanging a flexible liner impermeable to a desired liquid cargo material having an area extending across at least one of said compartments at least in the vicinity of a portion of the hull forming said at least one compartment; and fastening said liner within said compartment to retain said liquid cargo therein and to provide cargo-free space between said hull and said liner, the minimum distance between said hull and said liner when said liner contains cargo being selected and the location within said compartment of said fastening being selected such that such cargo is retained within said liner despite puncture and entry into said hull by a foreign object to a distance greater than said minimum distance.

18. A method according to claim 17 wherein:

at least one of said compartments is defined by a portion of said bottom of said hull and a plurality of vertically extending interior bulkheads, all of which bulkheads are spaced away from said hull side walls to form an interior compartment; and said step of fastening said liner comprises fastening said liner within said interior compartment above said portion of said bottom of said hull at a height below a midpoint of said interior bulkheads.

19. A method according to claim 18 wherein:

said step of fastening comprises fastening said liner below the water line for said ship when said ship is loaded with cargo.

20. A method according to claim 17 wherein:

at least one of said compartments is defined by a portion of said bottom of said hull, a portion of one or more side walls of said hull and at least one vertically extending bulkhead intersecting said hull to form an exterior compartment; and said step of fastening comprises fastening said liner within said exterior compartment at a height substantially above a midpoint of said bulkhead.

21. A method according to claim 20 wherein:

said step of fastening comprises fastening said liner at a height which is above the water line for said ship when loaded with cargo.

22. A method according to claim 17 wherein:

said step of suspending comprises placing said flexible liner into its respective compartment such that, when filled with liquid cargo, such liner extends not more than to a predetermined minimum distance from said hull.

23. A method according to claim 17 wherein:

said step of fastening comprises clamping an upper boundary of said flexible liner to said compartment so as to form a leak resistant seal along said boundary to retain liquid cargo within said compartment.

24. Apparatus for preventing the discharge of liquid cargo from a vessel when such vessel is subjected to puncture below the cargo line by a foreign object comprising;

an outer substantially water tight structural hull having at least a bottom and side walls enclosing an interior cargo space and normally separating said space from surrounding exterior water;

a plurality of interior rigid bulkheads, at least some of which are fastened to said hull, to define compartments within said cargo space;

a flexible, free-hanging liner impermeable to a desired liquid cargo material having an area extending across at least one of said compartments at least in the vicinity of the portion of said hull forming said at least one compartment; and means for fastening said liner within said compartment in a sagging manner to retain said liquid cargo therein and to provide cargo-free space between said hull and said liner, the minimum distance between said hull and said liner when said liner contains cargo being selected and the location within said compartment of said means for fastening being selected such that said cargo is retained within said liner despite puncture and entry into said hull by a foreign object to a distance greater than said minimum distance.

25. Apparatus according to claim 24 wherein:

at least one of said compartments is defined by a portion of said bottom of said hull and a plurality of vertically extending interior bulkheads, all of which bulkheads are spaced away from said hull side walls to form an interior compartment; and said means for fastening said liner is disposed within said interior compartment above said portion of said bottom of said hull at a height below a midpoint of said interior bulkheads.

26. Apparatus according to claim 25 wherein:

said means for fastening is below the water line for said vessel when loaded with cargo.

27. Apparatus according to claim 25 or claim 26 wherein:

said liner comprises a flexible, integral, liquid impermeable bag having a bottom portion and vertically extending side wall portions, said side wall portions being dimensioned so that said liner contains a volume of liquid cargo which is substantially less than the volume of an associated interior compartment.

28. Apparatus according to claim 24 wherein:

at least one of said compartments is defined by a portion of said bottom of said hull, a portion of one or more side walls of said hull and at least one vertically extending bulkhead intersecting said hull to form an exterior compartment; and said means for fastening said liner is disposed within said exterior compartment at a height substantially above a midpoint of said bulkhead.

29. Apparatus according to claim 28 wherein:

said means for fastening is disposed at a height which is above the water line for said vessel when loaded with cargo.

30. Apparatus according to claim 28 or claim 29 wherein:

said liner comprises a flexible, integral, liquid impermeable bag having a bottom portion and vertically extending side wall portions having dimensions sufficient to contain a volume of liquid cargo which is less than but a major fraction of the volume of an associated exterior compartment.

31. In a liquid cargo vessel having a hull with at least one cargo compartment, the improvement comprising at least one open-top, flexible free-hanging liner operatively arranged to sag in a respective one of the at least one compartment and made of a material impermeable to liquid cargo carried by the vessel, said liner being configured and dimensioned to define a predetermined minimum distance from at least one of the bottom and sides of the hull such that said liquid cargo is retained within said liner despite puncture and entry into said hull by a foreign object to a distance greater than said minimum distance.

32. In a liquid cargo vessel having an outer, substantially watertight structural hull comprising a bottom portion and upstanding side wall portions and one or more horizontally disposed decks defining, in combination, a maximum closed liquid cargo space, a plurality of interior bulkheads, at least some of which are fastened at extreme ends to said hull, and a plurality of vertical walls which are spaced away from said hull side walls and intersect said bulkheads; said hull side walls, portions of said bottom portion and said bulkheads and selected ones of said vertical walls forming exterior compartments, and said other portions of said bottom portion and said bulkheads and said vertical walls forming interior compartments within said cargo space, the improvement comprising apparatus for preventing discharge of liquid cargo from said cargo compartments when said vessel is subjected to puncture below the cargo line by a foreign object comprising a flexible, open top, free-hanging liner made from a material that is impermeable to a predetermined liquid cargo material, said liner having a sagging bottom and vertical walls and extending across at least the bottom area of at least one of said compartments, said liner being shaped and configured so as to remain at a predetermined minimum distance from said compartments bottom and at least one of walls and hull, when said liner is loaded with the liquid cargo material; and means for fastening a top boundary of said liner within said compartment in a sagging manner to retain said liquid cargo material therein and to aid positioning of said liner at said predetermined minimum distance away from said compartments walls so that said cargo is retained within said liner notwithstanding puncture of and entry into at least one of said hull and said compartment by a foreign object to a distance equal to or greater than said predetermined minimum distance.

* * * * *